US005479469A

United States Patent [19]

Fraser et al.

[11] Patent Number: 5,479,469

[45] Date of Patent: Dec. 26, 1995

[54] MICRO-CHANNEL PLATES

[75] Inventors: George W. Fraser; Richard Willingale, both of Leicester, England

[73] Assignee: U.S. Philips Corporation, New York, N.Y.

[21] Appl. No.: 251,539

[22] Filed: May 31, 1994

[30] Foreign Application Priority Data

May 28, 1993 [GB] United Kingdom ..... 9311134

[51] Int. Cl.[6] ..... G21K 1/02

[52] U.S. Cl. ..... 378/149; 250/505.1

[58] Field of Search ..... 378/149; 250/363.1, 250/505.1

[56] References Cited

U.S. PATENT DOCUMENTS 4,271,362 6/1981 Stone et al. ..... 378/149

5,008,911 4/1991 Harding ..... 378/149

5,231,654 7/1993 Kwasnick ..... 378/149

OTHER PUBLICATIONS

G. W. Fraser et al., "X–ray focusing using microchannel plates", SPIE, vol. 1546, 1991, pp. 41–52.

P. Kaaret et al., "X–ray focusing using microchannel plates", Applied Optics, vol. 31, No. 34, Dec. 1, 1992.

*Primary Examiner*—Craig E. Church

*Attorney, Agent, or Firm*—Leroy Eason

[57] ABSTRACT

A micro-channel plate for use in focusing X-rays or particles of equivalent wavelengths has a radially packed array of square pores. For focussing parallel rays, such micro-channel plate may consist of two square-pore spherically curved and radially packed micro-channel plate elements having different radii of curvature and overlying one another, forming a concavo-convex compound plate. Such a plate is capable of providing a greater effective area than prior art square packed micro-channel plates at high X-ray energies.

5 Claims, 3 Drawing Sheets

MICRO-CHANNEL PLATES

BACKGROUND OF THE INVENTION

1. Field of the Invention

This invention relates to micro-channel plates (MCP's). The invention is concerned particularly with MCP's for use in imaging x-rays and particles having equivalent wavelengths.

2. Description of the Related Art

MCP's have been utilised to perform a lens function in x-ray and the like imaging applications. X-rays, or, particles reflected at grazing incidence from the internal glass walls of the channels, or pores, of the MCP can be brought to a focus.

Square pore MCP's have been successfully applied in focusing X-rays or particles having equivalent wavelengths, for example neutrons, and have been used for example in X-ray telescopes. Other possible uses include X-ray lithography, flux concentration for X-ray scattering experiments, neutron focusing, X-ray microscopy and in diagnostic and therapeutic X-ray machines.

The use of square pore MCPs in X-ray imaging is described in, for example, the paper entitled "X-ray focusing using micro-channel plates" by P. Kaaret et al published in Applied Optics vol. 31, No. 34, pages 7339 to 7343, 1992. In an experimental arrangement described in this paper a flat (planar) MCP is utilised to focus diverging X-rays from a point source located at a finite distance from the MCP to an image. The pores of the MCP are parallel to each other and tilted relative to the surface by a bias angle and the MCP is orientated such that the pore axes are parallel to the optical axis.

As is mentioned in this paper, square pore MCP's are considered to offer an improvement over MCP's having circular pores as they lead to a significant increase in the intensity of the focused beam which, it is said, is due to the fact that the angles of incidence and reflection are the same regardless of the point of reflection in the square geometry.

Square pore MCP's for X-ray and the like imaging have also been produced in a spherically curved configuration in which the axis of each pore is aligned radially with respect to a spherical surface. By arranging that the axes of the pores extend normal to the spherical surface in this manner, parallel rays from a source at infinity can be imaged. The use of such an MCP is reported in the paper entitled "X-ray focussing using microchannel plates" by G. W. Fraser et al published in SPIE Proceeding, Vol. 1546, page 41–52, 11991.

In these MCP's the pores are square-packed, that is to say, in cross-section, the pores are arranged in othogonal rows and columns, in a grid like pattern.

We have found that improved results are achieved with a different arrangement.

SUMMARY OF THE INVENTION

According to the present invention there is provided a micro-channel plate comprising an array of square pores which is characterised in that the pores of the array are radially packed.

The MCP may be curved, preferably spherically, for imaging, for example, parallel X-rays from a source at infinity, or flat for imaging diverging rays from a source at a finite distance.

A radially packed, square pore, MCP has been found to provide improved performance compared with that of a square packed, square pore, MCP. Because of the so-called point spread function, a square pore MCP whose pores are arranged in a square grid of rows and columns of pores, gives an image in the form of a cross. With a radially packed, square pore array, the central focus is retained but the cross is lost. The radially packed square pore MCP leads also to a more useful effective aperture.

In a preferred embodiment the micro-channel plate, suitable for use in focusing parallel X-rays and the like, comprises first and second spherically curved micro-channel plate elements of different radii of curvature overlying one another, the pores of the first element aligned with and communicating with the pores of the second element. More specifically, the plate may comprise a concavo-convex compound array having a first plano-convex element of radius R and a second plano-concave element of radius less than R, for example R/3. Such a plate will have a greater effective focusing area—a measure of its efficiency in focusing x-rays—than a square packed array, particularly at hard x-ray frequencies.

BRIEF DESCRIPTION OF THE DRAWINGS

An embodiment of a micro-channel plate according to the invention will now be described, by way of example, with reference to the accompanying drawings, in which.

DESCRIPTION OF THE PREFERRED EMBODIMENTS

It should be understood that the Figures are merely diagrammatic and are not drawn to scale. Certain dimensions, in particular the size of the pores in relation to the overall MCP dimensions, and the degree of curvature have been greatly exaggerated.

Figure 1:
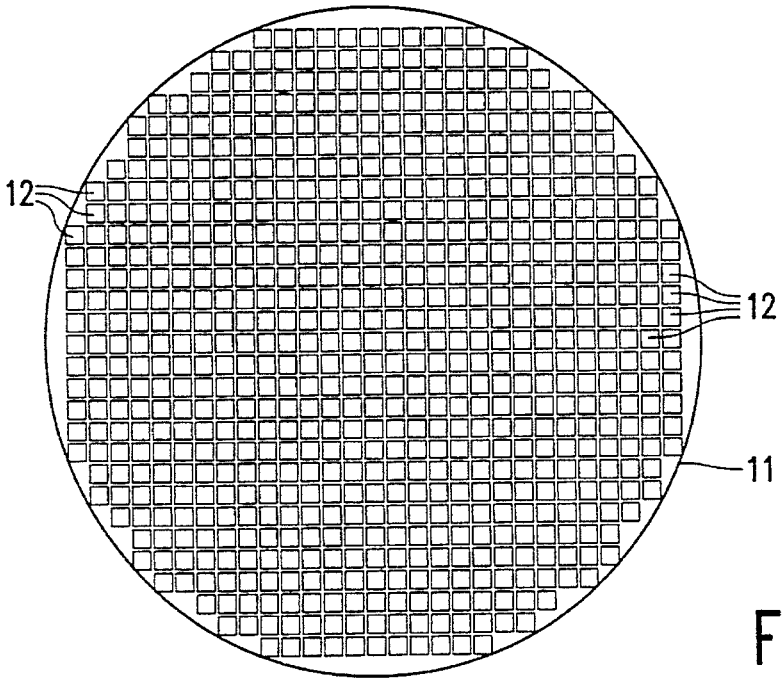
FIG. 1 is a diagrammatic face-on view of a prior art MCP having a square packed, square pore array.
Figure 2:
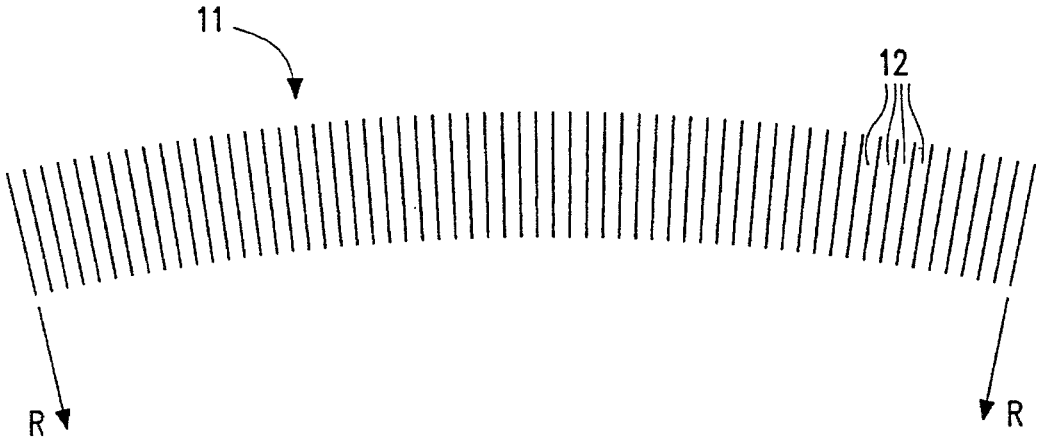
FIG. 2 is a diagrammatic cross-section through the prior art MCP of FIG. 1.

FIGS. 1 and 2 illustrate a prior art radially curved, square packed, square pore MCP 11 with a radius of curvature R which can for example be 5 or 10 m. Being square packed the MCP has a grid like array of square section pores, or channels, 12 in which the individual pores 12 are aligned in orthogonal rows and columns. In the diagrammatic illustrations of FIGS. 1 and 2 the pores are shown greatly enlarged for the sake of clarity. A typical diameter for such an array is 60 mm with each pore 12 being, say, 12.5 μm square and having a length of 8 mm. Because of the curvature, the pore size at the opposing sides may differ slightly.

As can be seen in FIG. 2, the pores 12 of the spherically curved MCP 11 are stacked with their axes extending normal to the spherical surface of the MCP, these axes coinciding at the centre of curvature of the plate.

For more details of square pore MCPs and their use in x-ray focusing applications and the like reference is invited to the aforementioned published technical papers, which are incorporated herein by reference.

Figure 3:
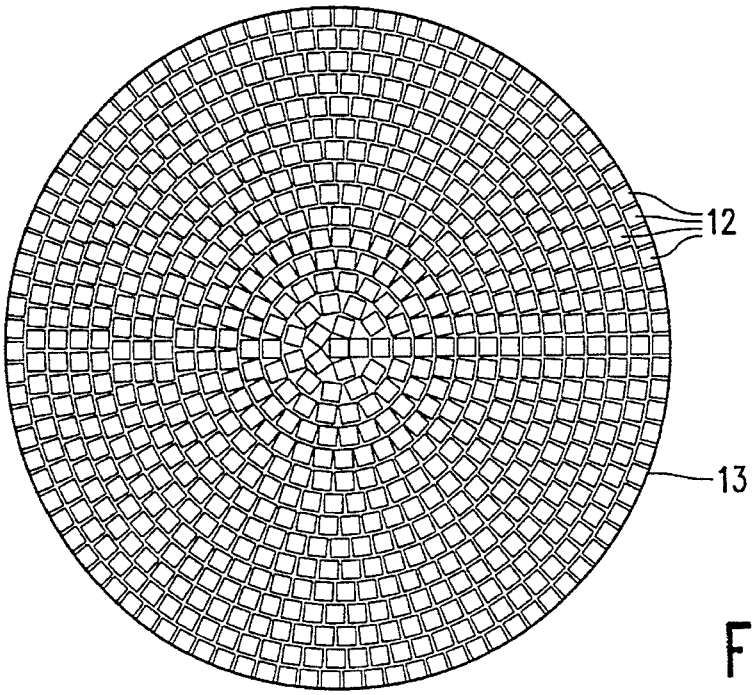
FIG. 3 is a diagrammatic face-on view of an embodiment of MCP according to the invention.
Figure 4:
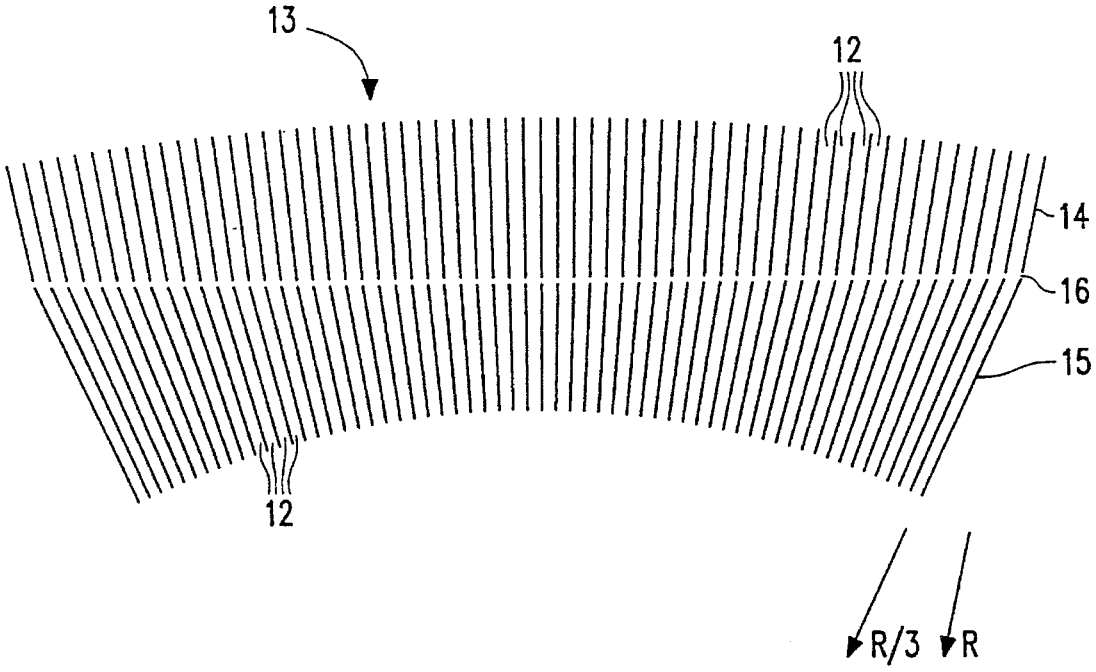
FIG. 4 is a diagrammatic cross-section of the MCP of FIG. 3.

FIG. 3 and 4 illustrate an embodiment of an MCP in accordance with the invention which comprises a compound MCP 13 having a concavo-convex configuration and consisting of first plano-convex MCP element 14 and a second plano-concave MCP element 15 overlying one another in tandem. Each of the MCP elements 14, 15 comprises a radially packed, square pore MCP.

FIG. 3 shows the pore array geometry of the radially packed MCP. As can be seen from this figure, the pores 12 of square cross-section are arranged in a series of juxtaposed concentric circles, the number of pores lying side by side in each circle being determined by the circle's radius, with one side of each of the pores in each respective circle extending substantially tangentially of the circle. The flat sides of the MCP elements 14 and 15 face one another and the pores 12 of the element 14 are aligned with the pores 12 of the element 15 at a plane interface, referenced at 16, such that the pores of the element 14 communicate with respective pores of the element 15.

As before, the pores of the arrays are shown greatly enlarged for the sake of clarity.

The radius R of the plano-convex element 14 is typically 15 m, and that of the element 15 is R/3, typically 5 m.

The radially packed array of the MCP 13 may have a typical diameter of 60 mm with the pores in each element 14 and 15 having an overall length of 8 mm and being 12.5 μm square.

With this MCP in use, for example, in X-ray imaging, rays reflected at grazing incidence from the internal walls of the pores 12 can be brought to a focus. Normally, when using an MCP, and considering parallel rays, e.g. from a source at infinity, only rays which suffer two reflections of adjacent walls are brought to focus. Single reflection rays produce an aberration in the form of a cross around the true image and those that pass straight through simply add to any diffuse background.

In order to collect and focus parallel rays from a source at infinity using a square packed MCP having a grid-like pore geometry, as shown in FIG. 1, the array is curved at a radius of curvature R equal to twice the required focal length f. The grazing angle at the edge of the array is then determined according to the ratio of the diameter of the array to the focal length. To achieve high utilisation of the aperture at a given X-ray energy, it is necessary for the width to length ratio of the pores, and the grazing angle near the edges of the array, which should be close to the critical angle for the rays, to obey a certain relationship. Consequently, the collecting geometric area (aperture) of the array is small. Furthermore, only a fraction of this area is dedicated to the double reflection focused rays with the rest being blocked or lost to the single reflection or straight through rays.

A much higher fraction of the aperture can be usefully employed using a radial packing arrangement for the pores of the array, as in the MCP elements 14 and 15 of FIG. 3 and 4. Then, unlike the MCP of FIGS. 1 and 2, the cross-section of the MCP is effectively the same for all azimuthal positions. Considering the element 14, for example, all the pores at a given radius provide the same projected single reflection area of on-axis rays and the rays are brought to a focus at f=R/2. Rays at an angle to the axis are not focused to a point and can lead to circular aberration. This aberration is corrected by introducing a second reflection in the same plane through the use of the second radially packed pore array of the MCP element 15 having a smaller radius of curvature, which, in the case of the embodiment of FIGS. 3 and 4, is one third that of the first. Paraxial rays are brought to a point focus at f=R/4 with a width corresponding approximately to the pure width.

Figure 5:
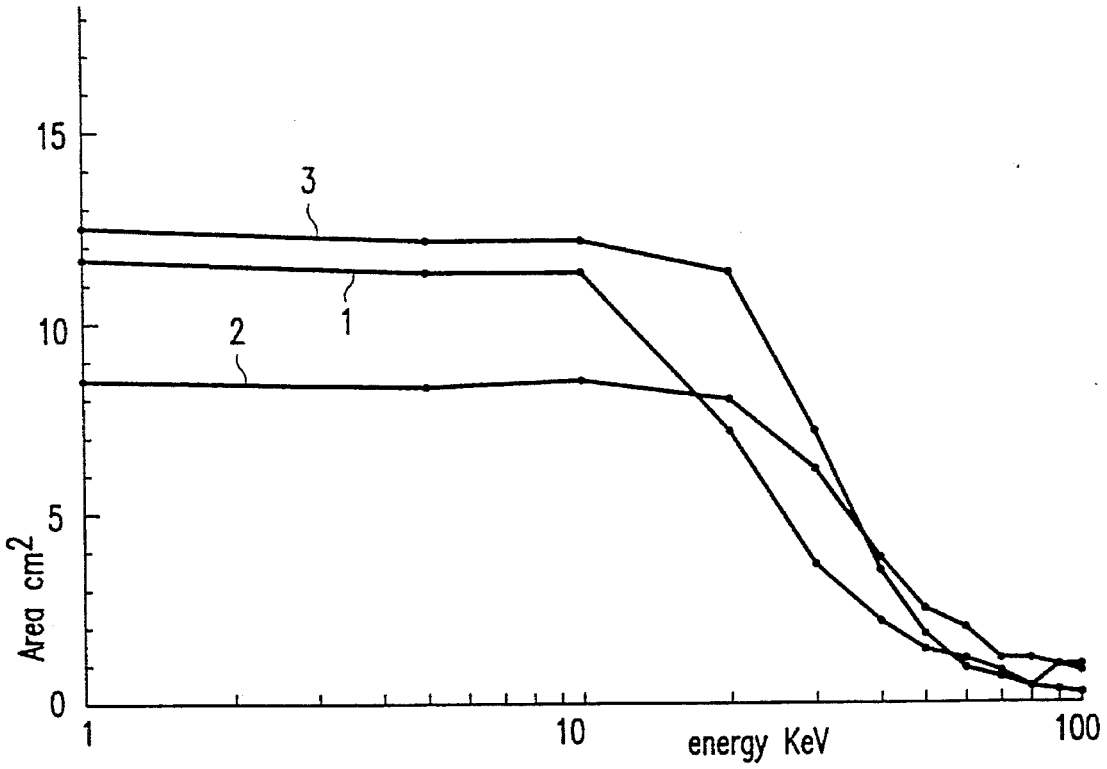
FIG. 5 is a graph showing the effective areas of two prior art plates and an MCP as illustrated in FIGS. 3 and 4.

FIG. 5 illustrates the effective collecting, areas of three plates of like diameter, pore size and packing, at different energies of X-rays. Curves 1 and 2 are for prior art square packed radially curved arrays as illustrated in FIGS. 1 and 2, of radii (focal length) 5 m and 10 m respectively. Curve 3 is for a tandem, radially packed configuration as illustrated in FIGS. 3 and 4 of focal length 5 m. The graphs show theoretical effective areas after pore surface roughness has been accounted for, and illustrate that the improvement brought about by the invention is particularly apparent at harder X-ray frequencies, that is, higher X-ray energy levels. At lower energies the improvement is less pronounced although still significant.

The MCP elements are formed of lead glass, such as Corning 8161 glass, which can be reduced in hydrogen to give a high surface lead content for improved reflectivity.

The MCP's, like those with circular channels used for electron multiplication purposes in image intensifiers and the like, may be fabricated by drawing, stacking and etching of glass fibres consisting of an acid soluble core glass and an acid resistant lead glass cladding. Square cross-section fibres are bundled, drawn and fused to form a boule with radially packed pore geometry and the required pore diameter. The boule is then sliced to produce a plate of the required thickness. Curvature corresponding to the desired radius of curvature can be achieved by heating the plate above its softening point between spherical mandrels prior to the final etching stage. For the MCP of FIGS. 3 and 4, consisting of tandem MCP elements, two plates may be cut from the same boule. Each plate is then curved to the required radius (R=2f and R=2f/3). Thereafter, the plates can be ground, lapped and polished on their joint plane to provide the necessary channel alignment, following which the two plates are cemented together in alignment.

Although a square-pore, spherically-curved, radially packed MCP comprising two MCP elements in tandem has been described in particular, other embodiments are possible. Thus, for example, in another embodiment the MCP may instead comprise a single plate having a radially-packed array of square pores. Depending on whether the MCP is intended to be used for rays, or particles, which are parallel, as, for example, from a source at infinity, or diverging, as, for example, from a source located at a certain distance from the MCP, the MCP may be curved or flat. Moreover, if curved, the curvature may perhaps be other than spherical.

From reading the present disclosure, other modifications will be apparent to persons skilled in the art. Such modifications may involve other features which are already known in the field of MCPs and which may be used instead of, or in addition to, features already described herein.

We claim:

1. A micro-channel plate for projecting a focused image of radiation incident thereon having a wavelength in the X-ray band, the plate comprising an array of glass-walled square pores which are internally reflective, the projected image being formed by the reflected radiation resulting from the portion of the incident radiation having a grazing angle of incidence on the walls of said pores; characterized in that said pores are radially packed around an optical axis of said array, whereby all pores at a given radius produce the same area of the projected image formed from incident radiation on said plate in a direction parallel to said optical axis.

2. A micro-channel plate according to claim 1, characterised in that the plate is spherically curved.

3. A micro-channel plate according to claim 2, characterized in that the plate comprises first and second spherically curved micro-channel plate elements of different radii of curvature, overlying one another with the pores of the first micro-channel plate element aligned and communicating with the pores of the second micro-channel plate element; whereby circular aberration due to off-axis radiation incident on said plate is avoided because such radiation is subjected to a second reflection by the pores of said second micro-channel plate element following a first reflection thereof by the pores of said first micro-channel plate element.

4. A micro-channel plate according to claim 3, characterised in that the plate comprises a concavo-convex plate in which the first element is plano-convex and the second element is plano-concave and of a radius less than the radius of the first element.

5. A micro-channel plate according to claim 4, characterised in that the radius of the second element is one third that of the first element.

* * * * *